US005437325A

United States Patent [19]

Legrand et al.

[11] Patent Number: 5,437,325

[45] Date of Patent: Aug. 1, 1995

[54] DEVICE FOR RAPIDLY CHANGING AND MAINTAINING A LATERAL WALL OF A MACHINE FOR THE CONTINUOUS CASTING OF A METAL PRODUCT BETWEEN ROLLS

[75] Inventors: Hugues Legrand, Antony; François Mazodier, Saint Etienne, both of France

[73] Assignees: Usinor Sacilor, Puteaux; Thyssen Stahl Aktiengesellschaft, Duisburg, Germany

[21] Appl. No.: 224,293

[22] Filed: Apr. 7, 1994

[30] Foreign Application Priority Data

Apr. 14, 1993 [FR] France ..... 93 04 384

[51] Int. Cl.[6] ..... B22D 11/06

[52] U.S. Cl. ..... 164/428; 164/480

[58] Field of Search ..... 164/428, 480

[56] References Cited

FOREIGN PATENT DOCUMENTS 0450775 10/1991 European Pat. Off. .

OTHER PUBLICATIONS

Patent Abstracts of Japan, vol. 14, No. 42 (M-925) (3985) Jan. 25, 1980 & JP-A-01 273 65, Nov. 1, 1989, Saburo Moriwaki, "Method for continuously casting Strip and Continuous Casting Machine".

Patent Abstracts of Japan, vol. 13, No. 360 (N-858) (3708) Aug. 11, 1989 & JP-A-01 118 345, May 10, 1978, Akira ABO, "Device for Adjusting Short Side Mold Support in Continuous Casting Machine".

Patent Abstracts of Japan, vol. 10, No. 388(M-549) (2445) Dec. 25, 1986 & JP-A-61, Aug. 8, 1986, Nobuhiro Tazoe, "Starting Method of Casting and Side Seal Heater in Roll Type Continuous Casting Installation".

*Primary Examiner*—Kuang Y. Lin

*Attorney, Agent, or Firm*—Oblon, Spivak, McClelland, Maier & Neustadt

[57] ABSTRACT

The continuous casting machine comprises two counter-rotary rolls (1, 2) having parallel axes disposed in confronting relation with a given gap therebetween and on the axial ends of which two lateral walls (5*a*) are applied so as to define a pouring space (3) between the rolls. The rapid changing device for the lateral wall (5*a*) comprises a turret (14) having means (16) for fixing at least two lateral walls in positions which are separated from each other by a rotation through a given angle about the axis of the turret. Means for shifting the turret in rotation in steps of amplitude corresponding to the given angle of rotation permit shifting one lateral replacement wall (5*b*) from a standby position to a position occupied by the lateral wall (5*a*) which is in service and has to be replaced.

FIG. 1 .

10 Claims, 4 Drawing Sheets

DEVICE FOR RAPIDLY CHANGING AND MAINTAINING A LATERAL WALL OF A MACHINE FOR THE CONTINUOUS CASTING OF A METAL PRODUCT BETWEEN ROLLS

The invention relates to the rapid replacement of a lateral wall of a machine for the continuous casting of a metal product comprising two counter-rotary rolls.

Devices are known for the continuous casting of a metal product and in particular of a thin metal strip the ingot mould of which is essentially constituted by two counter-rotary rolls having horizontal and parallel axes and disposed in confronting relation with a gap therebetween corresponding to the thickness of the product to be cast.

The liquid metal is poured into a pouring space defined by the portions of the surfaces of the rolls located above a plane passing through the parallel axes of these rolls and by lateral transverse end walls, termed "side dams", bearing against the transverse axial end faces of the rolls.

The side dams must be applied against the axial ends of the rolls so as to obtain an effective seal to avoid any leakage of the molten metal.

It is also necessary to avoid or to limit the solidification of the metal upon contact with the lateral walls. For this purpose, it has been proposed to make the lateral walls of a heat insulating material so as to prevent a considerable cooling of the molten metal upon contact therewith.

It has also been proposed to employ lateral walls which comprise a part composed of a heat insulating refractory material inserted between the rolls and placed between two metal plates in the shape of portions of a ring each applied against a planar transverse end face of each cylinder.

In any case, the lateral walls are subject to wear in operation owing to the fact that they come into contact with the poured metal which is in process of solidifying and moves in the gap between the rolls, and with the edge portions of the rotating rolls.

Consequently, the worn lateral walls must be replaced by new walls after a certain time of operation of the casting machine.

To replace the lateral walls, the casting must be stopped by closing the outlet of the distributor disposed above the ingot mould.

After the closure of the distributor, the pouring continues until the complete emptying of the ingot mould. The side dams are then replaced.

The side dams disposed on each side of the ends of the rolls are supported by carriages movably mounted on guiding slideways parallel to the axes of the rolls and associated with devices for shifting them in translation between a forward service position in which the active parts of the side dams are in contact with the rolls and a withdrawn position out of operation in which the side dams are spaced away from the rolls.

The new replacement side dams are mounted on the corresponding carriages in the withdrawn position of the latter.

The carriages are then put back into their forward service position in which they put and maintain the side dams in contact with the ends of the rolls.

The casting can then be resumed by putting the stopper of the distributor back into its opening position.

In actual fact, the time required for replacing the side dams, between the closure of the distributor and its reopening for resuming the casting is usually very long (on the order of 20 to 45 minutes) and consequently it is necessary to completely empty the distributor before carrying out a side dam replacing operation since it is difficult to maintain liquid metal in the distributor during this time.

Before resuming the casting, it is therefore necessary to fill the distributor with liquid metal contained in a pouring ladle.

Certain operations for the maintenance of the casting machine, for example the cleaning of the rolls or the changing of the distributor can be carried out simultaneously without loss of time during the changing of the side dams.

However, the necessity to replace the side dams after a certain period of continuous operation of the machine results in an overall discontinuous operation with relatively long periods of interruption with a consequential substantial reduction in the productivity of the machine.

No device for rapidly changing the side dams of a casting machine has been known up to the present time which permits greatly reducing the time required to rearm the casting machine, i.e. the time between the closure of the distributor before the operation for replacing the side dams and the reopening of the distributor after the side dams have been changed, to obtain a practically continuous operation of the machine with interruptions of short duration, for example less than three minutes.

An object of the invention is therefore to propose a device for rapidly changing a lateral wall of a machine for the continuous casting of a metal product comprising two counter-rotary rolls having parallel axes disposed in confronting relation with a given gap therebetween, against the axial ends of which two lateral walls bear so as to define a pouring space between the rolls and comprising a carriage for the shifting of the lateral wall mounted on a support to be movable in the axial direction of the rolls between a forward position and a withdrawn position relative to the rolls, said device enabling the time for rearming the machine to be reduced to a very low value for changing the lateral walls so as to ensure a practically continuous operation of the casting machine and increase the productivity of the latter.

To this end, the device according to the invention further comprises:

- a turret mounted on the carriage to be rotatable about an axis perpendicular to the axis of the rolls, and comprising means for fixing at least two lateral walls in positions which are separated from each other by a rotation through a given angle about the axis of the turret, and
- means for shifting the turret in rotation by steps of an amplitude corresponding to said given angle of rotation so as to shift a lateral replacement wall from a standby position to a position occupied by a lateral wall which is in service and has to be replaced.

Another advantage of the device according to the invention is that it permits easily effecting without loss of time a preheating of the lateral replacement wall or walls before they are put into service.

Indeed, it is known that the side dams must be heated before they are put into service so as to ensure that the poured metal does not freeze upon contact therewith.

For this purpose burners may be used which act either on the active side of the side dams or on the rear side of the latter. In the first case, and in a device of the prior art, it is a delicate operation to effect this preheating when the side dam is in the service position, since there is a danger of deteriorating the rolls with the flame of the burners. Further, the duration of the preheating is relatively long and this is incompatible with a rapid replacement of the side dams. In the second case, there is less risk of harming the rolls but the duration of the preheating remains unacceptable, the preheating is not carried under good conditions since it is performed on the side of the side dam remote from that which will be in contact with the poured metal, and the supporting of the side dam is rendered complicated.

Further, a preheating effected before placing the side dams on their support would overcome the aforementioned problems but would oblige the operators to handle the side dams brought to a very high temperature for fixing them to their support, which would be very dangerous.

These problems may be overcome by the device according to the invention by the use of preheating means acting on the standby lateral wall or walls after they have been placed in position on the turret. The preheating may in this way be effected on the side of the wall which will subsequently be in contact with the liquid metal and consequently the temperature of this side will be as high as possible before the lateral wall is put into service so that the lateral wall will be immediately operational once it has been put into its service position.

For the purpose of explaining the invention, there will now be described, by way of a non-limitative example, with reference to the accompanying drawings, an embodiment of a device for rapidly changing and maintaining a lateral wall according to the invention, in the case of a machine for the continuous casting of a thin steel strip.

Figure 1:
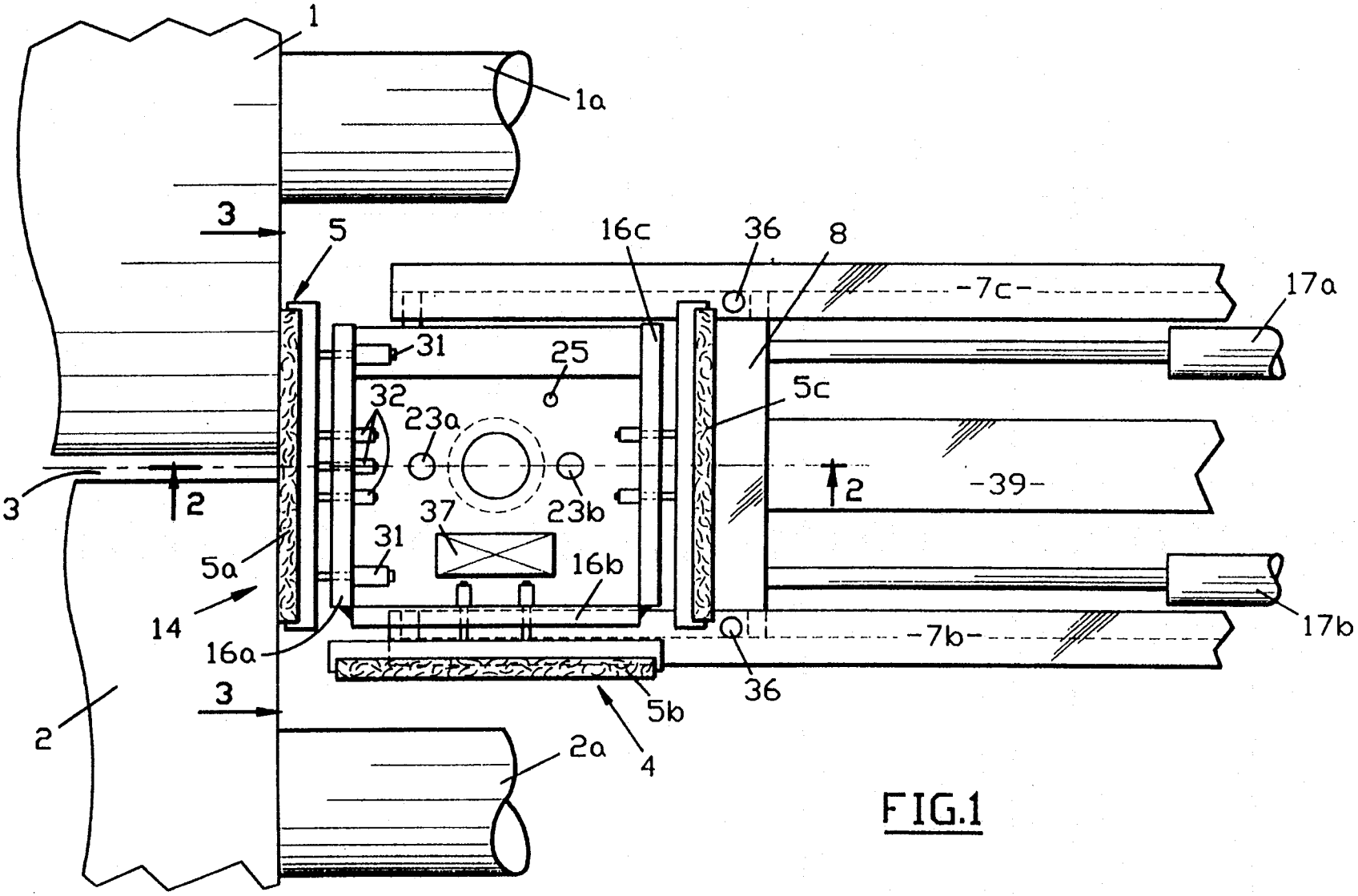
FIG. 1 is a top plan view of a part of the casting machine and of a device for changing and maintaining a lateral wall according to a first embodiment of the invention.

Shown in FIG. 1 is a part of the casting plant constituted by two rolls 1, 2 arranged with their axes horizontal and parallel and defining therebetween a narrow gap 3 substantially corresponding to the thickness of the steel strip produced by casting between the rolls 1 and 2.

The rolls 1 and 2 respectively include extensions 1*a* and 2*a* whereby the rolls 1 and 2 are rotatively mounted in bearings and driven in rotation in opposite directions.

The extensions may be mounted on the same side of the rolls, as shown in FIG. 1, or on one side for one roll and on the other side for the other roll.

The rolls 1 and 2 define between their lateral surfaces above a horizontal plane passing through their axes at the level of which the gap 3 between the rolls is the smallest, a pouring space which is closed, in the region of the longitudinal ends of the rolls 1 and 2, by two lateral walls, such as the wall 5, maintained against the rolls 1 and 2 in a clamped and sealed position by a device for rapidly changing and maintaining the lateral wall according to the invention generally designated by the reference numeral 4.

There will now be described the device for rapidly changing and maintaining the lateral wall 4 according to the invention with reference to FIGS. 1, 2 and 3.

The device 4 comprises a support 6 bearing through the medium of a base 6*a* on the floor of the casting machine and two lateral uprights 6*b* and 6*c* fixed by brackets on the base 6*a* and carrying in their upper part a longitudinal slideway, respectively 7*b* and 7*c*, constituted by two elements assembled and fixed by screws.

The lateral uprights 6*b* and 6*c* of the support and the corresponding slideways 7*b* and 7*c* are arranged in the direction parallel to the axes of the rolls 1 and 2, or the longitudinal direction, on each side of the vertical median plane of the pouring space 3.

A carriage 8 is mounted to be movable in translation in the longitudinal direction on the support 6 by means of the slideways 7*b* and 7*c*, the carriage 8 including lateral guide members 8*b* and 8*c* which are engaged between the two parts of the slideways respectively 7*b* and 7*c*.

Figure 2:
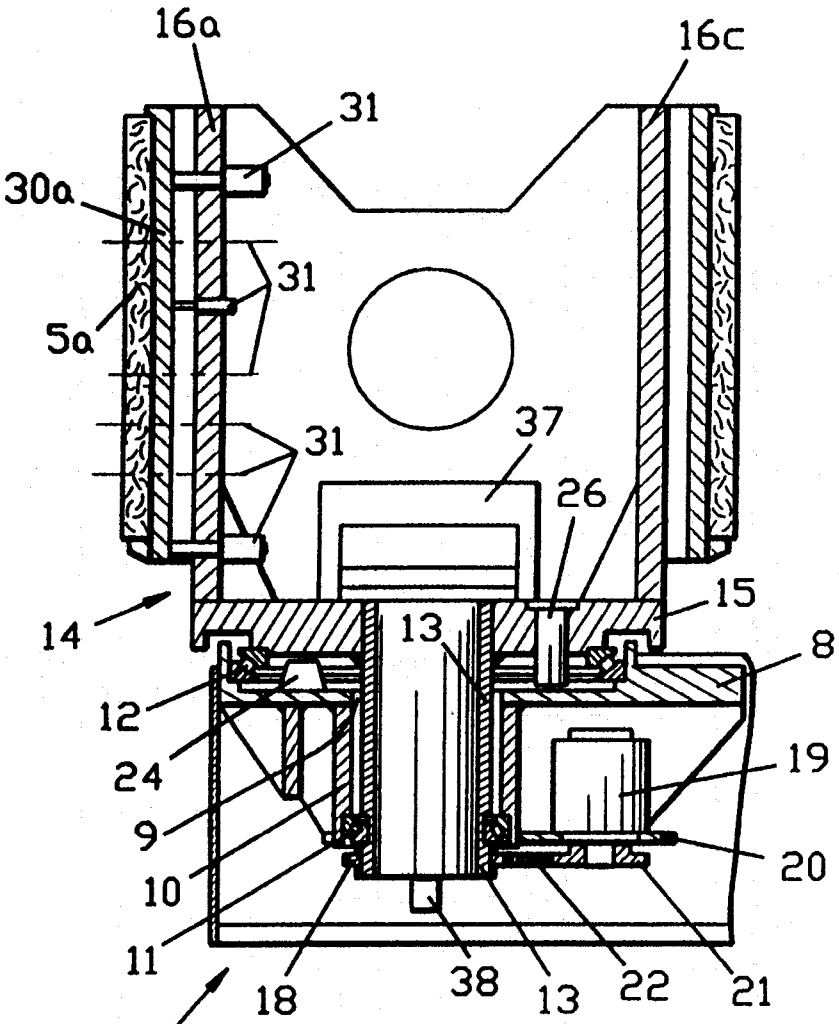
FIG. 2 is a sectional view taken on line 2—2 of FIG. 1.

As can be seen in FIG. 2, the carriage 8 includes a through opening 9 in the region of which is fixed a column 10 having a vertical axis, extending downwardly inside the support 6 and carrying at its lower end a bearing 11 having a vertical axis. The support 6 also carries on its upper surface a ring 12 constituted by a tapered roller bearing coaxial with the column 10 and the bearing 11.

A turret 14 is mounted to be rotatable about the vertical axis of the column 10 of the support 8 by means of the bearing 12 and a tubular shaft 13 rotatively mounted inside the bearing 11.

The turret 14 comprises a base 15 bearing against the inner ring of the tapered roller bearing 12 and lateral walls 16*a*, 16*b* and 16*c* bearing on the base 15 and assembled by welding along their edges in their upper parts so as to be located on three sides of a parallelogram. Each of the vertical walls 16*a*, 16*b*, 16*c* of the turret 14 includes means for fixing a lateral wall 5 such as the lateral wall 5*a* in service against the rolls 1 and 2 and the walls 5*b* and 5*c* which may be formed by new lateral walls in a standby position on the turret 14.

The support 6 carries two actuators or cylinder devices 17*a* and 17*b* for shifting in translation in the longitudinal direction the carriage 8 carrying the turret 14 on which the lateral walls are fixed.

Each of the cylinder devices 17*a* and 17*b* comprises a body fixed to the support 6 and a rod connected to the rear end of the carriage 8.

The cylinder devices 17*a* and 17*b* permit shifting the carriage 8 carrying the turret 14 between a forward position adjacent the rolls such as that shown in FIG. 1 and a withdrawn position in which the turret 14 and the lateral wall 5 are spaced away from the transverse end faces of the rolls 1 and 2.

The tubular shaft 13 of the turret 14 is connected at its lower end to a chain wheel 18.

The turret 14 which is rotatable on the support 8 about the vertical axis common to the bearings 11 and 12 can be driven in rotation by a hydraulic rotary actuator 19 fixed to a support 20 connected to the column 10. The actuator 19 comprises a vertical rotary shaft on which is fixed a chain sprocket 21 which drives the chain wheel 18 connected to the tubular shaft 13 through a chain 22 engaged on the teeth of the chain wheel 18 and chain sprocket 21.

The carriage 8 carries on its upper surface a fixed stop 24 and the base 15 of the turret 14 has openings such as 23*a* and 23*b* which extends therethrough and in which a movable stop such as 26 is engageable.

Further, the support 6 carries an indexing cylinder device 25 having a vertical disposition and including a rod to the end of which is fixed a locking pin 25*a*.

When the carriage 8 has been placed in its withdrawn position by means of the cylinder devices 17*a* and 17*b*, the turret 14 is sufficiently spaced away from the rolls 1 and 2 to be rotatable about its vertical axis for presenting a new lateral wall in front of the rolls 1 and 2.

A rotation of the turret 14 through a quarter of a turn permits placing the wall 5*b* in confronting relation to the rolls, i.e. in the position previously occupied by the wall 5*a*.

The rotation of the turret 14 through a quarter of a turn thus permits placing a new lateral wall in a position of engagement with the transverse end surfaces of the rolls 1 and 2.

The movable stop 26 is placed in such position that this stop comes into contact with the fixed stop 24 when the turret has travelled through a quarter of a turn in the desired direction (for example, as viewed in FIG. 1, in the clockwise direction, for orienting the wall 5*b* in the initial orientation of the wall 5*a*).

The contact between the movable stop 26 and the fixed stop 24 permits stopping the rotation of the turret after a quarter of a turn. In the event that only two side dams are mounted symmetrically on the turret, the latter may effect between two stop positions, half-turns alternately in one direction and in the other. In the case of more than two side dams, at least one of the stops is withdrawable.

The turret 14 is immobilized and fixed in position by the stud 25*a* of the indexing cylinder device 25 which is engaged in an opening of the base 15 of the turret situated in a position permitting the indexing of the turret.

Figure 3:
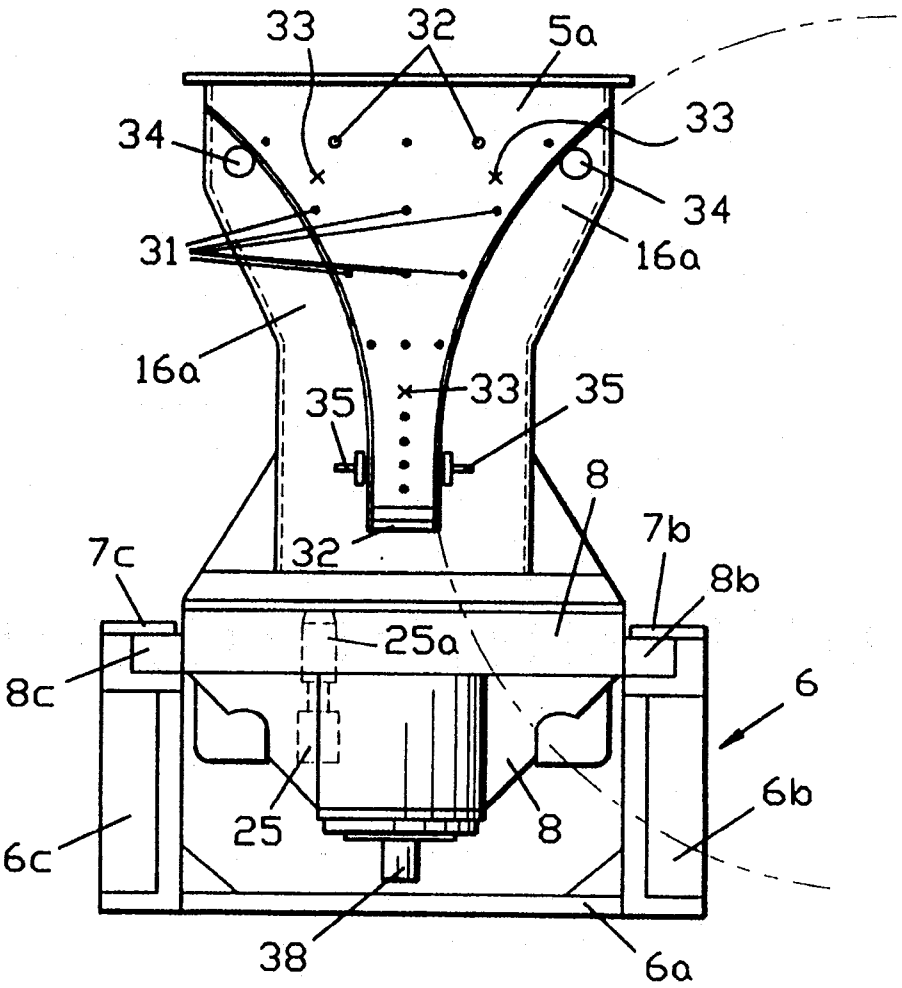
FIG. 3 is a side elevational view taken on line 3—3 of FIG. 1.

As can be seen, in particular in FIGS. 2 and 3, the side damn such as 5*a*, 5*b* and 5*c* which are composed at least partly of a refractory material having opposed circular edges corresponding to the edges of the rolls 1 and 2 with which they come into contact. The refractory material is preferably inserted in a metal case which forms a pre-assembled unit termed a cassette.

The side dam 5*a* shown in FIGS. 2 and 3 is fixed to a metal support 30*a* which is connected to the vertical wall 16*a* of the turret by connecting means allowing a certain latitude of movement of the side dam 5*a* in the longitudinal direction to ensure the clamping against the transverse end faces of the rolls 1 and 2.

These connecting means comprise a group of thrust cylinder devices 31 fixed to the wall 16*a* and having rods connected to the support 30*a*, at a group of points distributed over the area of the side dam, as can be seen in FIG. 3.

The cylinder devices 31 exert a thrust on the support 30*a* in the longitudinal direction toward the ends of the rolls 1 and 2 so as to apply the side dam 5*a* in a sealed manner against the rolls when the turret 14 and the carriage 8 are in their forward position as shown in FIG. 1.

The cylinder devices 31 may be replaced by thrust springs interposed between the front surface of the wall 16*a* of the cylinder device and the rear surface of the support 30*a*.

The connecting means also comprise return cylinder devices or springs 32 connected to the support 30*a* in its upper part and its lower part so as to exert on the cassette a return force in the longitudinal direction in the direction opposed to the force exerted by the thrust devices 31.

Displacement sensors 33 are also disposed between the wall 16*a* and the support 30*a* so as to determine the displacements and the position of the support 30*a* during the positioning of the side dam 5*a* and during the utilization of the casting machine. The sensors 33 permit in particular monitoring the positioning and the wear of the side dam 5*a*.

The thrust means 31 and the return means 32 of the side dam 5*a* the active part of which comes into contact with the rolls 1 and 2, provide a flexible fixing of the cassette which has a certain latitude of displacement in the horizontal direction.

The support 30*a* of the side dam 5*a* bears against pins 34 which maintain it in the vertical direction and against lateral stops 35 which maintain it in the transverse direction during the casting.

There will now be described an operation for changing a lateral wall by means of the device according to the invention such as that shown in FIGS. 1, 2 and 3.

When there has been detected by means of the displacement sensors 33 a wear of the active part of the lateral wall 5*a* which requires its displacement, the liquid metal supply distributor for the ingot mould constituted by the rolls and the side dams is closed and the pouring is continued until the ingot mould is completely emptied.

The carriage 8 and the turret 14 are then shifted toward a withdrawn position spaced away from the rolls 1 and 2 by means of the cylinder devices 17*a* and 17*b* fixed to the support 6.

The position of the stops is verified so as to cause the turret to turn through a quarter of a turn in the desired direction, for example to place the side dam 5*b* in a position in facing relation to the ends of the rolls 1 and 2, at the place of the side dam 5*a*.

The side dam 5*b* is provided with a new active part and has been preheated by a device (not shown) which may be for example a burner or a radiating heating device employing a resistance.

The carriage 8 and the turret 14 are then shifted in the direction toward the rolls 1 and 2 until the active part 5*b* of the side dam comes into contact with the ends of the rolls and is held against the rolls with a certain pressure by means of the thrust devices 31.

The carriage 8 carrying the turret 14 is clamped in the region of the slideways 7*b* and 7*c* in its forward position by clamping cylinder devices 36.

During all the operations for changing the side dam, it is possible to effect partly within the available lapse of time, a brushing of the end parts and of the cylindrical surface of the rolls to eliminate particles for example of slag which may have adhered to these surfaces. In this way the quality of the product is improved when restarting the casting.

It is possible to achieve by means of the device according to the invention changes of the lateral walls within a very short period of time, for example on the order of three minutes or less.

Owing to the very short time required for changing the side dam it is possible to effect the change without emptying the distributor.

It is also possible to maintain the rolls in rotation during the changing operations.

The various cylinder devices for clamping and returning the cassette carrying the active part of the side dam are supplied with fluid by a hydraulic unit 37 located inside the turret 14 above the upper end of the column 13.

The supply cables and piping of the hydraulic unit 37 enter the interior of the column 13 and turret through a rotating joint 38 connected to the lower end of the carriage 8.

The means for guiding the supply cables and piping of the side dam and turret are formed by a cable-carrying chain 39 disposed on the upper part of the support 6.

Figure 5:
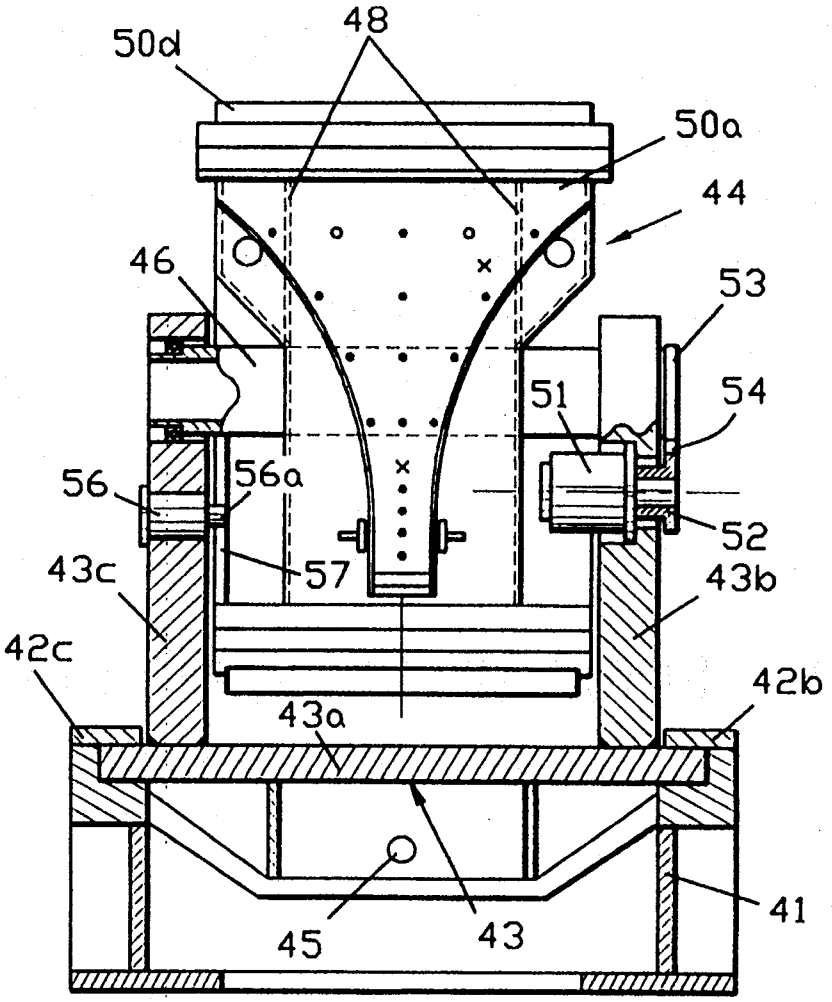
FIG. 5 is a view in elevation and partly in section taken on line 5—5 of FIG. 4.
Figure 4:
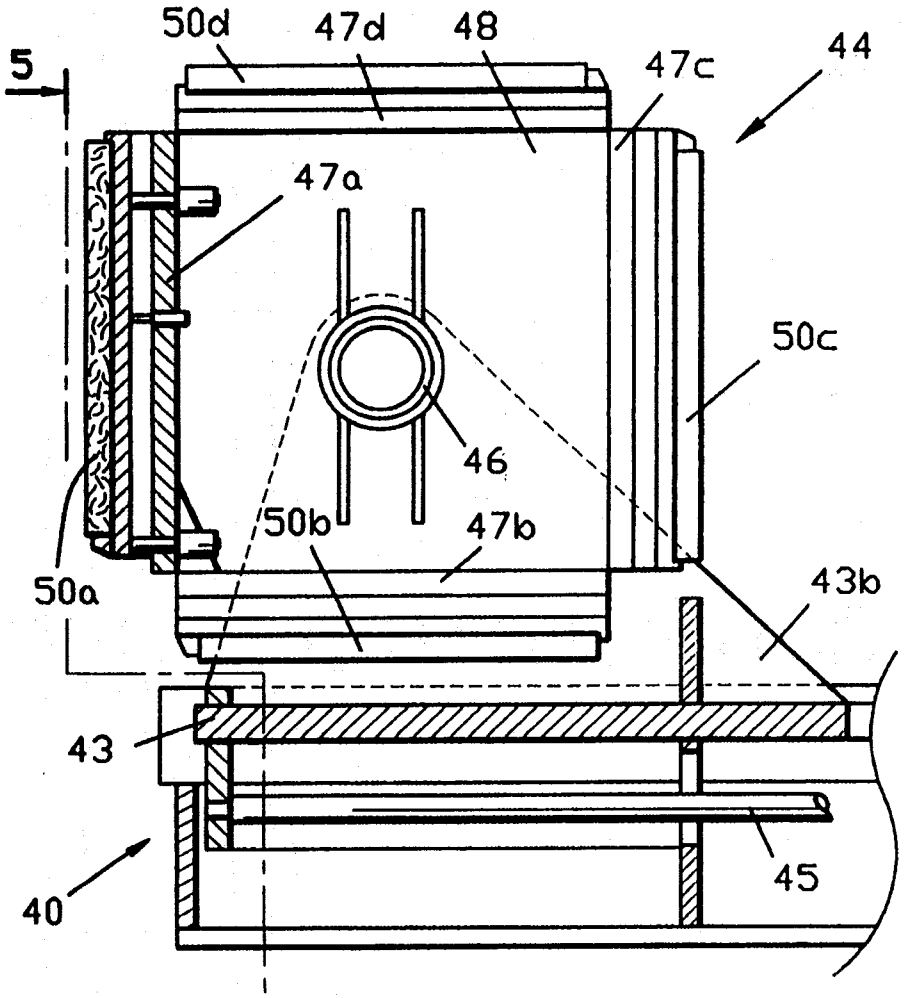
FIG. 4 is a longitudinal sectional view, similar to the sectional view of FIG. 2, of a second embodiment of a device according to the invention.

FIGS. 4 and 5 show a device for rapidly changing a lateral wall according to a second embodiment of the invention.

The changing device generally designated by the reference numeral 40 comprises a support 41 extending in a longitudinal direction and fixed to the floor of the casting machine and including vertical lateral uprights to the upper part of which are fixed longitudinally extending slideways **42*b* and 42*c*. A carriage 43 is mounted to be movable in the longitudinal direction on the support 41 by means of outer lateral parts of its base 43*a***.

The carriage 43 may be shifted in the longitudinal direction on the support 41 by a hydraulic cylinder device carried by the support 41 and having a rod 45 connected to the carriage 43.

The carriage 43 comprises two vertical uprights **43*b* and 43*c* fixed by welding to the upper side of the base 43*a***.

A turret 44 is rotatively mounted between the uprights **43*b* and 43*c* by means of a tubular shaft 46 having a horizontal disposition the end parts of which are mounted in bearings carried by the uprights 43*b* and 43*c*** respectively.

The shaft 46 constituting the central part of the turret is connected to four walls **47*a*, 47*b*, 47*c* and 47*d* by braces 48**.

Each of the walls **47*a*, 47*b*, 47*c*, 47*d* carries a cassette comprising a cassette support and the active part of a side dam. The active parts of the side dams fixed to the walls 47*a*, 47*b*, 47*c* and 47*d* and the corresponding side dams are respectively designated by the reference characters 50*a*, 50*b*, 50*c* and 50*d***.

The cassette supports on which the side dams **50*a*, 50*b*, 50*c*, 50*d* are fixed are themselves connected to the walls 47*a*, 47*b*, 47*c*, 47*d* in the manner described with reference to the wall 5*a* of the device shown in FIGS. 1, 2 and 3**.

A rotary hydraulic actuator 51 is fixed in a through opening in the lateral upright **43*b* of the carriage 43. The shaft of the actuator 51 carries a wheel 52 whereby it is possible to drive in rotation, through a chain or belt 54, a second wheel 53 fixed to the end of the tubular shaft 46 of the turret 44**.

The upright **43*c* of the carriage 43 carries an indexing cylinder device 56 whose rod 56*a* can be engaged in an opening in a wall 57 connected to the tubular shaft 46 of the turret 44. The indexing cylinder device 56 permits locking the turret 44 in position after a rotation thereof which brought the active part 50*a*** of a side dam in facing relation to the rolls.

The operation of the device shown in FIGS. 4 and 5 is substantially identical to that described with respect to the device shown in FIGS. 1, 2 and 3. The active parts of the side dams **50*a*, 50*b*, 50*c*, 50*d* may be brought by successive rotations through a quarter of a turn in facing relation to the rolls of the casting machine when the carriage 43** is placed in the withdrawn position.

The differences between the devices shown in FIGS. 1, 2 and 3 and the device shown in FIGS. 4 and 5 relate to the direction of the axis of rotation of the turret (vertical in the first case and horizontal in the second case) and to the presence, in the second case, of four sides of the turret whereby it is possible to place in position four cassettes carrying the active parts of four side dams.

It will be clear that in the case of the device having a turret with a vertical axis shown in FIGS. 1 to 3, it is also possible to place four side dams on four walls of the turret instead of the described three side dams.

Figure 7:
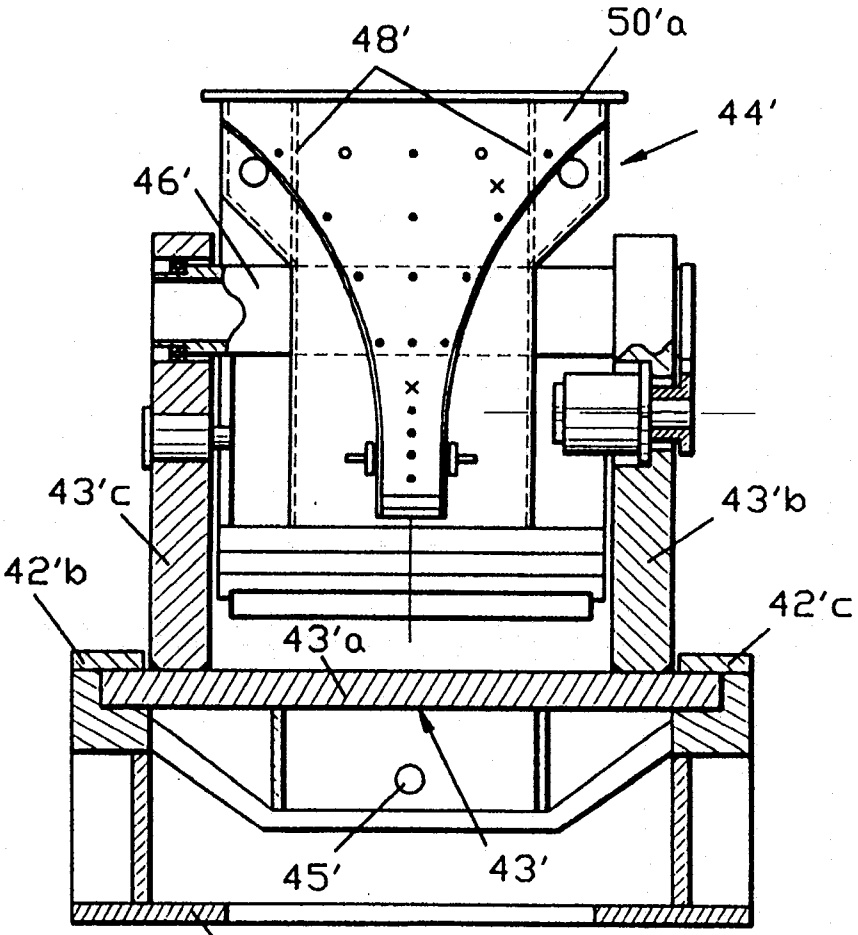
FIG. 7 is a view in front elevation and in partial section taken on line 7—7 of FIG. 6.
Figure 6:
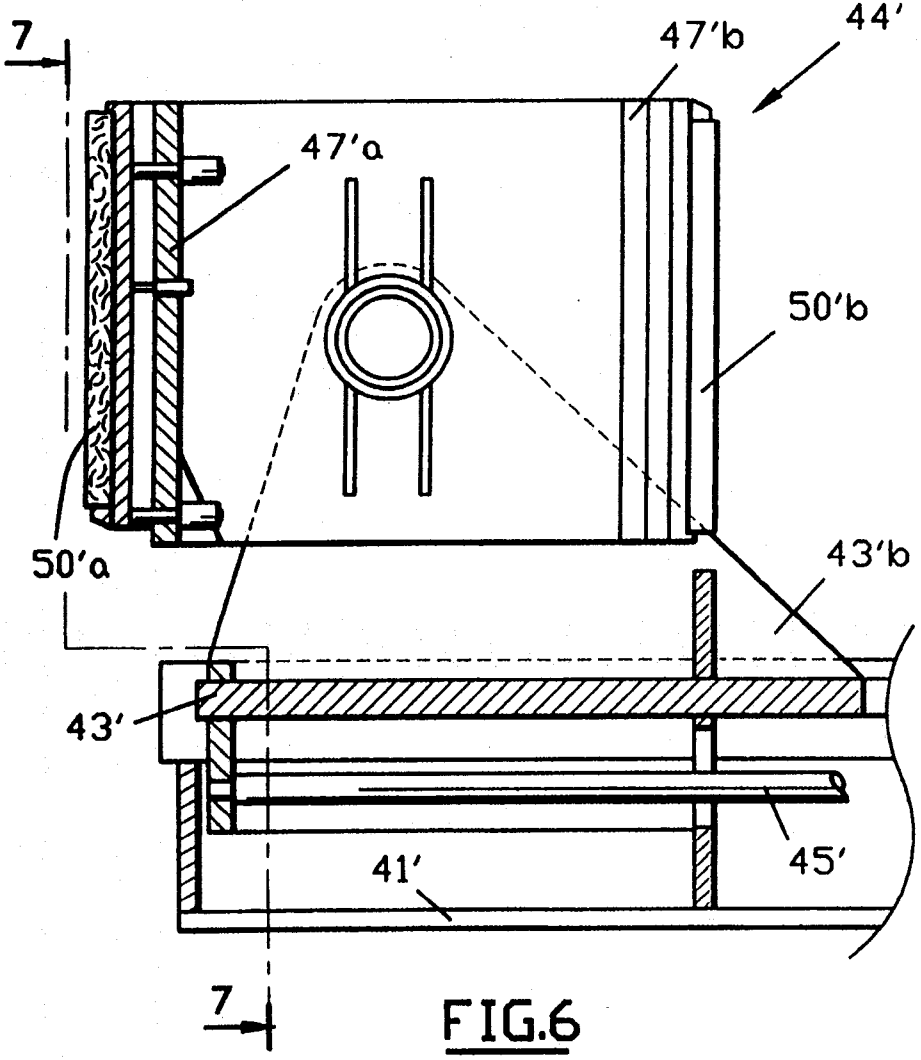
FIG. 6 is a longitudinal sectional view, similar to the sectional view of FIG. 4, of an alternative arrangement of the device according to the second embodiment.

Shown in FIGS. 6 and 7 is an alternative embodiment of the rapid changing device shown in FIGS. 4 and 5, the corresponding elements in FIGS. 4 and 5 on one hand and in FIGS. 6 and 7 on the other hand carrying the same reference characters to which a prime is added in the case of the elements of the device shown in FIGS. 6 and 7.

The device shown in FIGS. 6 and 7 comprises a longitudinal support 41' the lateral uprights of which carry in their upper part slideways **42'*b* and 42'*c*. A carriage 43' is mounted to be movable in the longitudinal direction relative to the support 41' by means of lateral parts of the base of the carriage 43'*a* engaged in the slideways 42'*b* and 42'*c*. A cylinder device of which the rod 45' connected to the carriage 43' has been shown in FIGS. 6 and 7 permits shifting the carriage 43'** between a forward position in the vicinity of the ends of the rolls of a casting plant and a withdrawn position.

The carriage 43' comprises lateral uprights **43'*b* and 43'*c* between which a turret 44' is rotatively mounted by means of a horizontal tubular shaft 46'**.

The turret 44' comprises two parallel walls **47'*a* and 47'*b* each carrying a support cassette of the active part 50'*a* or 50'*b*** of a side dam of the casting machine.

The support cassettes of the side dams are connected to the corresponding walls **47'*a* and 47'*b* in a manner identical to that in which the support cassettes of the side dams 50*a*, 50*b*, 50*c*, 50*d* are connected to the walls 47*a*, 47*b*, 47*c* and 47*d* of the turret 44 shown in FIGS. 4 and 5**.

The difference between the turrets of the devices shown in FIGS. 4 and 5 on one hand and FIGS. 6 and 7 on the other hand is that the turret of the device of FIGS. 4 and 5 has four support walls for four side dams whereas the turret of the device shown in FIGS. 6 and 7 has only two support walls for two side dams.

When the carriage 43' and the turret 44' are in a withdrawn position relative to the rolls of the casting machine, the turret 44' may be rotated through a half-turn so as to invert the positions of the side dams **50'*a* and 50'*b***.

Before changing a side dam, it is possible, as before, to preheat the replacement side dam before placing it, by rotating the turret, in a position facing the rolls.

In the case of the replacing devices shown in FIGS. 1 to 3, 4 and 5, and 6 and 7 respectively, after replacing a worn side dam, this worn side dam may be taken down after restarting the casting plant, the corresponding position on the turret being accessible. There is then carried out the mounting of a cassette comprising a new active part on the corresponding wall of the turret, and the preheating of the side dam in this position.

In all cases, the device according to the invention permits achieving very rapidly the changing of the lateral walls or side dams of the continuous casting machine.

The device according to the invention also permits achieving in a simple manner the preheating of the side dams before they are put into their service position against the rolls of the casting machine.

It also permits placing in position on the turret, during the operation of the casting machine, the new replacement lateral walls.

It must be understood that the scope of the invention is not intended to be limited to the embodiments described.

Thus the support, the carriage and the turret and their shifting means may be arranged in a manner different from that described.

The turret may have only two walls permitting putting two side dams in position or, on the contrary, a larger number of walls permitting placing in position more than two walls simultaneously on the turret.

When the device comprises preheating burners, it is advantageous, although not indispensable, for reasons of overall size, to place these burners in a position parallel to the axes of the rolls, by making them act on a lateral replacement wall located symmetrically with the lateral wall in service relative to the axis of the turret. The turret may then have only two lateral walls disposed symmetrically, one being exchanged and preheated while the other is in service.

The invention is applicable not only to machines for casting strips between rolls but also to machines casting other metal products between rolls.

What is claimed is:

1. Device for rapidly changing and maintaining a lateral wall of a machine for the continuous casting of a metal product which comprises two counter-rotary rolls which have axial ends and parallel axes, are disposed in confronting relation and define a given gap therebetween, two lateral walls bearing against said axial ends of said rolls so as to define a pouring space between said rolls and said lateral walls, said device comprising in combination: a support, a carriage for shifting said lateral wall mounted on said support to be movable in a direction parallel to said axes of said rolls between a forward position and a withdrawn position relative to said rolls, a turret mounted on said carriage to be rotatable about an axis perpendicular to said axes of said rolls, and comprising means for fixing at least two lateral walls in positions separated from each other by a rotation through a given angle about said axis of said turret, and means for shifting said turret in rotation in steps of an amplitude corresponding to said given angle of rotation of said turret so as to shift a replacement lateral wall from a standby position to a position occupied by a lateral wall which is in service and has to be replaced.

2. Device according to claim 1, wherein said turret is mounted to be rotatable about a vertical axis.

3. Device according to claim 1, wherein said turret is mounted to be rotatable about a horizontal axis.

4. Device according to claim 1, wherein said turret has a plurality of planar faces, said fixing means comprise for each lateral wall a support on which the respective lateral wall is fixed, and connecting means between said support of said lateral wall and a respective one of said planar faces of said turret.

5. Device according to claim 4, wherein said turret has two of said planar faces parallel to each other, said positions being separated from each other by a rotation through a half of a turn of said turret about said axis thereof.

6. Device according to claim 4, wherein said planar faces of said turret are perpendicular in pairs and disposed on sides of a parallelepiped, the positions of said planar faces in each pair being separated from each other by a rotation of said turret through a quarter of a turn about said axis thereof.

7. Device according to claim 6, wherein said turret comprises three planar faces which are perpendicular to each other in pairs.

8. Device according to claim 6, wherein said turret comprises four planar faces which are perpendicular to each other in pairs.

9. Device according to claim 1, further comprising, in association with said means for shifting said turret in rotation, stops fixed to said carriage and to said turret and interengageable so as to limit said rotation of said turret to a step having an amplitude corresponding to said given angle of rotation.

10. Device according to claim 1, further comprising heating means for preheating said replacement lateral wall in said standby position.

* * * * *